United States Patent [19]

Resnicow

[11] 4,138,656

[45] Feb. 6, 1979

[54] ATTACHMENT OF LEADS TO ELECTRICAL COMPONENTS

[75] Inventor: Leon Resnicow, Devon, Pa.

[73] Assignee: Vishay Intertechnology, Inc., Malvern, Pa.

[21] Appl. No.: 742,030

[22] Filed: Nov. 15, 1976

[51] Int. Cl.[2] ..... H01C 1/14

[52] U.S. Cl. ..... 338/322; 338/329

[58] Field of Search ..... 338/322, 323, 324, 328, 338/329, 334; 29/610, 613, 619, 621; 339/176 MP, 276 A, 258 R, 258 P; 361/306, 310

[56] References Cited

U.S. PATENT DOCUMENTS

| | | | |
|---|---|---|---|
| 1,608,005 | 11/1926 | Schoeppler | 338/324 X |
| 2,718,576 | 9/1955 | Kratochvil et al. | 338/329 X |
| 3,071,844 | 1/1963 | Krause et al. | 339/276 A |
| 3,238,429 | 3/1966 | Bornhorst | 361/310 X |
| 3,488,618 | 1/1970 | Yungblut et al. | 338/164 |
| 3,497,860 | 2/1970 | Patton, Jr. | 339/176 M |
| 3,688,245 | 8/1972 | Lockshaw | 339/278 C X |
| 3,718,883 | 2/1973 | Berman | 338/322 |

*Primary Examiner*—C. L. Albritton
*Attorney, Agent, or Firm*—Ferrill and Logan

[57] ABSTRACT

An electrical component, comprising an insulating substrate having conductive material applied to one side thereof and including terminal pad portions for attaching electrically connecting leads thereto, in which said leads are provided with relatively thick rigid portions adapted to extend externally of the component to provide means for making electrical connections thereto and have relatively thinner, less rigid portions mechanically bonded to the other side of said substrate and have end portions dressed around the edge of said substrate to said one side thereof and electrically connected to said terminal pad portions by brazing, welding or soldering. In a preferred form, said leads may be bonded to said substrate by epoxy or other suitable cement and the end portions thereof may be made even thinner than the remainder of said thinner portions to facilitate dressing them around the edge of said substrate into contact with said terminal pad portions.

7 Claims, 10 Drawing Figures

ATTACHMENT OF LEADS TO ELECTRICAL COMPONENTS

This invention relates to improvements in electrical components and more particularly to improved methods of and means for attaching electrically conductive leads to small electrical components such as precision resistors formed by producing a resistive path in a thin film of resistive material applied to an insulating substrate or coated metallic substrate, for example in the manner described in U.S. Pat. No. 3,405,381 granted Oct. 8, 1968 to Zandman, et al.

Such components, may be formed on a small slab of insulating material, such as glass or ceramic, or anodized aluminum, the dimensions of which may be of the order of 0.25 inch × 0.25 inch ×0.02 inch to which is bonded with cement a thin film of a resistive material, such as a nickel-chromium alloy which may be of the order of 0.0001 inch in thickness. This unit is known as a chip. The thin film is then photo-etched to produce a suitable pattern, which may comprise a plurality of interconnected linear portions to yield a path length having a desired resistance value. Also, at opposite ends of the resistive path there are produced, also by photo-etching, terminal pads to which electrically connecting leads may be attached.

In the past, because of the small size of such components, considerable difficulty has been experienced in providing electrical connections thereto which are both electrically satisfactory as well as mechanically rugged. One attempted solution to this problem involved the use of relatively thick, rigid electrical leads mechanically bonded to the component together with relatively thin interconnecting ribbons electrically connecting the relatively thick leads to the small terminal pads of the thin film, as shown and described in U.S. Pat. No. 3,718,883 granted Feb. 27, 1973 to Berman, et al., which patent also illustrates and describes various arrangements in accordance with the prior art. While the arrangement disclosed and claimed in that patent provided adequate mechanical strength and also provided a satisfactory method of making electrical connection to the relatively small terminal pads on the component side of the insulating substrate, it required the use of two separate welds for each connection to the terminal pads. Also, the choice of available interconnecting ribbon materials to be compatible for welding purposes to the thin terminal pad and to thick external lead resulted in thermal EMFs at the welds causing false resistance values to be produced where the component was a resistor. Furthermore, the use of separate flexible ribbons interconnecting the ends of the external leads to the terminal pads of the component presented an additional problem because of their tendency to be damaged during fabrication of the component.

It is an object of the present invention to provide an improved electrical component and method of constructing same of the sort above discussed which avoids the disadvantages of such components of the prior art above referred to.

More particularly it is an object of the invention to improve the reliability of an electrical component such as a thin-film resistor by reducing the number of welds required in making electrical connections thereto.

Another object of the invention is to provide an improved electrical component having improved electrical stability in an environment of thermal gradients because of reduction of thermal EMFs generated in the electrical connections thereto.

A further object of the invention is to provide an electrical component having improved mechanical strength and ruggedness and which is less susceptible to damage in the course of fabrication and is amenable to mechanical handling including accurate positioning in a mold cavity for subsequent encapsulation by molding.

A still further object of the invention is to accomplish all of the above by adjusting the lead cross section at different points along its length to be compatible with the mechanical and electrical requirements external and internal to the device with particular attention to compatible thickness at the point of welding to the thin film.

In accordance with the invention, the foregoing objects are achieved by providing an electrical component comprising: an insulating substrate, conductive material applied to one side of said substrate and including terminal pad portions for attaching electrically connecting leads thereto, and electrically connecting leads, said leads having relatively thick rigid portions adapted to extend externally of said component to provide means for making electrical connections to said component and having relatively thinner, less rigid portions mechanically bonded to the other side or sides of said substrate and having end portions dressed around the edge of said substrate to said one side thereof and being electrically connected to said terminal pad portions.

The invention will be fully understood from consideration of the following detailed description with reference to the accompanying drawings in which.

Figure 1:
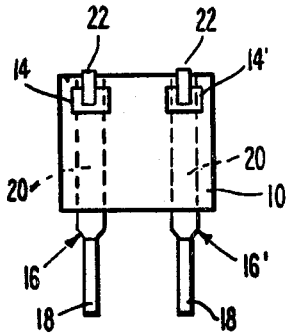
FIG. 1 is a front view of a preferred embodiment of the invention as applied to an electrical component formed on a square insulating substrate and having external leads extending from one side thereof.
Figure 2:
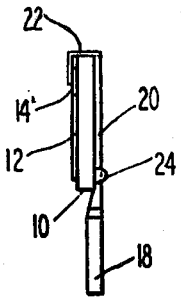
FIG. 2 is a side view of the electrical component of FIG. 1.
Figure 3A:
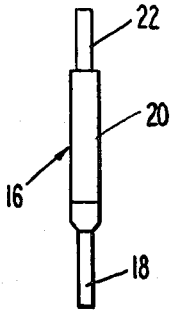
Figure 3B:
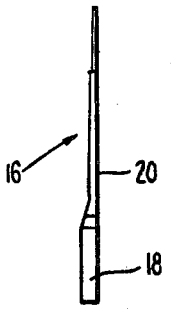
Figure 4A:
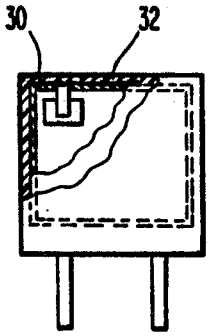
Figure 4B:
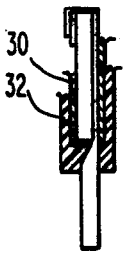

FIGS. 3A and 3B respectively are front and side views of an electrically connecting lead element used in the construction of the embodiment of FIGS. 1 and 2;

FIGS. 4A and 4B respectively are front and side views of the electrical component of FIGS. 1 and 2 embodying the invention encased in a protective enclosure.

Figure 5:
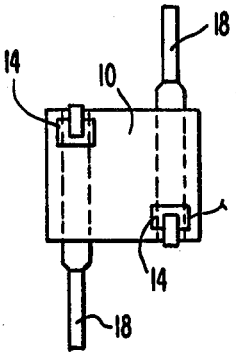
Figure 6:
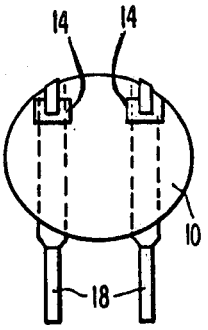
Figure 7:
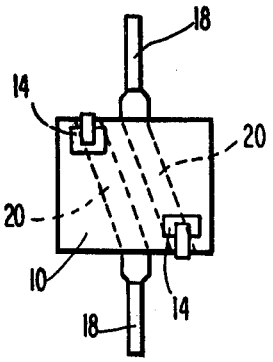
Figure 8:
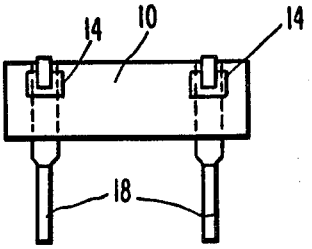

FIG. 5 is a front view of an alternative embodiment of the invention applied to an electrical component using a square substrate in which the external leads extend from opposite sides of the component;

FIG. 6 is a front view of another alternative embodiment of the invention as applied to an electrical component having a circular substrate with electrically connecting leads extending in the same direction therefrom;

FIG. 7 is a front view of yet another alternative embodiment of the invention as applied to an electrical component having a square substrate in which the external electrically connecting leads extend coaxially on opposite sides thereof;

FIG. 8 is a front view of yet another embodiment of the invention as applied to an electrical component having a rectangular substrate in which the electrically connecting leads extend in the same direction from one of the longer sides thereof.

Referring now to FIGS. 1 and 2, there is shown an electrical component comprising a square chip 10 of insulating material such as glass or ceramic which, as previously mentioned, may have lateral dimensions of the order of 0.25 inch × 0.25 inch and of the order of 0.02 inch in thickness. Chip 10 may have deposited thereon and affixed thereto a film 12 of resistive material, such as a nickel-chromium alloy or other suitable resistive material which, as previously indicated, has been photo-etched to form a resistive path formed in any suitable pattern such as a plurality of interconnected linear portions to provide a desired resistance value throughout the entire path. At the opposite ends of the path are provided terminal pads 14 and 14' for making electrical connections to the resistive path. These terminal pads typically may be of rectangular configuration having dimensions of the order of 0.030 inch × 0.050 inch, and as shown may be positioned near one edge of chip 10. External electrical connections to terminal pads 14 and 14' are made by electrically connecting lead elements 16 and 16', the configuration of which is shown in detail in FIGS. 3A and 3B. As there shown, lead elements 16 comprise relatively thick rigid portions 18 adapted to extend externally of the component to provide means for making electrical connections to the component and having relatively thinner, less rigid portions 20 adapted to extend across the back side of substrate 10, and even thinner and narrower portions 22 at the extremities thereof. Typically the portion 18 of lead 16 may be circular in cross section having a diameter of the order of 0.025 inch, portion 20 may be of rectangular cross section having a width of the order of 0.050 inch and a thickness of 0.010 inch, and portion 22 also may be of rectangular cross section having a width of the order of 0.034 inch and 0.005 inch thickness. While lead portions 18 have been described as being of circular cross section, they may equally well be of any other convenient cross section such as square, rectangular or polygonal. Lead element 16 may readily and conveniently be formed from a single piece of conductive wire, the portions 20 and 22 being reduced in thickness in accordance with the dimensions hereinbefore indicated by stamping, pressing, rolling, or etching, or in any other suitable manner. The wire used may be of any suitably conductive metal, one satisfactory example being tin/lead coated copper wire. If desired the wire used may be plated with gold or any other corrosion-resistant and solderable metal. When such forming is effected, the width of portion 20 will be substantially increased compared to the diameter of portion 18, and it may be unnecessary to reduce such increased width. However, portion 22 at the upper extremity of lead element 18 should be reduced in width by shearing, machining, etching, or any other suitable procedure to a width somewhat less than the width of the terminal pads 14, 14' of the electrical component with which lead elements 18 are to be used so as to admit of convenient attachment to terminal pads 14, 14' by welding, brazing or soldering, and also to admit of convenient forming of portions 22 around the edge and over the front side of chip 10.

As shown in FIG. 1, lead portions 20 are positioned across the back side of chip 10 and preferably are mechanically secured thereto by at least a single dot of a suitable cement 24, which may be of epoxy. However, if desired, lead portions 20 may be bonded to the back side of chip 10 throughout their entire length. Lead portions 22 are then bent around the edge of chip 10 and onto the front side of chip 10 so as to contact terminal pads 14 and 14'. Electrical connection to pads 14 and 14' are then made by welding, brazing or soldering. If welding is used, this may conveniently be accomplished using a conventional split electrode welder. Preferably the area being welded is flooded with argon gas supplied continuously at the rate of 5 cubic feet per hour. The welding voltage may be reduced as the electrodes become shorter from wear.

After the component has been fabricated in the manner described above, protective coatings may be applied thereto as shown in FIGS. 4A and 4B. First there may be applied a clear, moisture-proofing coating 30, which may be a silicone resin such as Dow Corning DC 875 or an epoxy resin, which coating may be of the order of 0.005 inch in thickness. Such coating may be applied by dipping, spraying, painting, cataphoretic coating or fluidized bed coating in accordance with the procedures well known in the art. Following this, and over the moisture-proofing coating there may be applied a thicker mechanically protective layer of material such as a room-temperature-vulcanizing silicone rubber which may be of the order of 0.010 inch in thickness and which provides a pliable cushioning layer for the device, which protects the chip from mechanical strains resulting from molding, shrinkage and the like.

Also, if desired, following the application of the aforementioned protective coatings, the device may be encapsulated by molding with any of the well-known compounds commonly used in encapsulating electronic devices such as epoxy molding compounds, diallyl phthalate compounds or silicone molding compounds to provide additional protection. The electrical component construction in accordance with the invention is particularly suited to the molding process used in such encapsulation since the rigidity of the external leads makes possible precise and stable positioning of the device within a mold.

The invention has been described in detail with reference to a preferred embodiment using a chip of square configuration. However, it will be apparent that it is equally applicable to devices of other configurations, typical examples of which are illustrated in FIGS. 5, 6, 7 and 8. Thus, FIG. 5 illustrates a device using a chip 10 also of square configuration but in which the leads 18 are connected to terminal pads 14 at opposite corners of chip 10 and in which the leads 18 extend from opposite sides of the chip, which may be of advantage in certain applications.

FIG. 6 illustrates a component using a chip 10 of circular configuration with terminal pads 14 positioned near one side of the circumference thereof and with lead elements 18 extending across the chip and past the opposite side thereof.

FIG. 7 illustrates a component using a square chip 10 having terminal pads 14 disposed at opposite corners thereof and in which the portions 20 of the lead elements 18 are arranged diagonally so that the external portions of leads 18 extend coaxially on opposite sides of the chip.

FIG. 8 illustrates a component using a chip 10 of rectangular configuration with the lead elements connected to terminal pads 14 positioned at opposite ends of the chip adjacent one of the longer sides thereof and in which leads 18 extend across the shorter dimension of chip 10 and extend from the opposite side thereof.

It will be understood that the construction of the components illustrated in FIGS. 5, 6, 7 and 8 may be carried out in essentially the same manner as described with reference to the embodiment of FIGS. 1, 2, 3A and 3B.

While the invention has been described with reference to a single preferred embodiment and various alternative versions, it will be understood that various modifications may be made such as will occur to those skilled in the art within the scope of the invention as defined by the following claims.

I claim:

1. An electrical component comprising:

(a) an insulating substrate, (b) a conductive material applied to one side of said substrate and including terminal pad portions for attaching electrically connecting leads, (c) and electrically connecting monolithic leads, said leads having relatively thick rigid portions adapted to extend externally of said component, having relatively thinner, less rigid portions bonded to the other side of said substrate, and having end portions dressed around the edge of said substrate to said one side thereof and electrically connected to said terminal pad portions, said end portions being substantially thinner and narrower than the remainder of said less rigid portions to render them compatible for attachment to said terminal pad portions by welding.

2. An electrical component according to claim 1 in which the rigid portions of said leads are of substantially circular cross section and in which said less rigid portions and said end portions are of substantially rectangular cross section.

3. An electrical component according to claim 1 in which the thicknesses of said end portions of said leads are of the order of fifty times the thicknesses of said terminal pad portions.

4. An electrical component according to claim 1 in which said terminal pad portions are of the order of one ten-thousandths of a inch in thickness and said end portions of said leads are of the order of five thousandths of an inch in thickness.

5. An electrical component according to claim 1 in which the widths of said end portions of said leads are substantially less than the widths of said terminal pad portions to which they are connected.

6. An electrical component according to claim 1 in which the widths of said end portions of said leads are of the order of two-thirds the widths of said terminal pad portions to which they are connected.

7. An electrical component according to claim 1 in which said insulating substrate is of substantially rectangular configuration having said terminal pad portions positioned adjacent opposite corners of said substrate, said leads extending diagonally across the back of said substrate to substantially oppositely positioned points on opposite edges thereof, the external connecting portions of said leads extending substantially coaxially from opposite edges of said substrate.

* * * * *